US006151760A

United States Patent [19]

Weber

[11] Patent Number: 6,151,760

[45] Date of Patent: Nov. 28, 2000

[54] SLIVER GUIDING ASSEMBLY FOR A DRAW FRAME

[75] Inventor: Wilfried Weber, Mönchengladbach, Germany

[73] Assignee: Trützschler GmbH & Co. KG, Mönchengladbach, Germany

[21] Appl. No.: 09/292,853

[22] Filed: Apr. 16, 1999

[30] Foreign Application Priority Data

Apr. 16, 1998 [DE] Germany ..... 198 16 812
Mar. 2, 1999 [DE] Germany ..... 199 09 040

[51] Int. Cl.[7] ..... D04H 11/00

[52] U.S. Cl. ..... 19/157; 19/150; 19/288

[58] Field of Search ..... 19/150, 157, 236, 19/237, 238, 239, 240, 259, 260, 159 R, 288, 291–292

[56] References Cited

U.S. PATENT DOCUMENTS

| | | | |
|---|---|---|---|
| 3,994,046 | 11/1976 | Brown et al. . | |
| 4,630,336 | 12/1986 | Schopwinkel et al. | 19/150 |
| 5,161,284 | 11/1992 | Leifeld | 19/260 |
| 5,461,757 | 10/1995 | Leifeld | 19/239 |
| 5,666,698 | 9/1997 | Nauthe et al. | 19/157 |
| 5,815,887 | 10/1998 | Nauthe et al. | 19/150 |

FOREIGN PATENT DOCUMENTS

| | | |
|---|---|---|
| 1 685 578 | 1/1974 | Germany . |
| 28 36 979 | 3/1980 | Germany . |
| 212 754 | 8/1984 | Germany . |
| 33 27 574 | 11/1984 | Germany . |
| 34 36 526 | 4/1986 | Germany . |
| 38 39 413 | 5/1990 | Germany . |
| 43 35 444 | 6/1994 | Germany . |
| 195 35 297 | 10/1996 | Germany . |
| 195 35 300 | 10/1996 | Germany . |
| 461 323 | 10/1968 | Switzerland . |
| 1051990 | 12/1966 | United Kingdom . |
| 2 132 240 | 7/1984 | United Kingdom . |
| 2 178 074 | 2/1987 | United Kingdom . |
| 2 277 106 | 10/1994 | United Kingdom . |

*Primary Examiner*—Michael A. Neas
*Assistant Examiner*—Gary L. Welch
*Attorney, Agent, or Firm*—Venable; Gabor J. Kelemen

[57] ABSTRACT

A sliver guiding assembly for the passage of a sliver bundle discharged in a sliver advancing direction by output rolls of a drawing unit forming part of a draw frame. The assembly includes a sliver guide having a wall face converging in a direction of the advancing direction and a passage provided in the wall face. The sliver bundle is adapted to travel through the passage in the advancing direction. A sliver leading element is disposed upstream of the passage as viewed in the advancing direction for gathering the sliver bundle and for guiding it toward the passage. An arrangement is provided for maintaining communication between a zone of the sliver guide and enviromental air; the zone is defined between the outlet of the sliver leading element and the inlet of the passage.

17 Claims, 4 Drawing Sheets

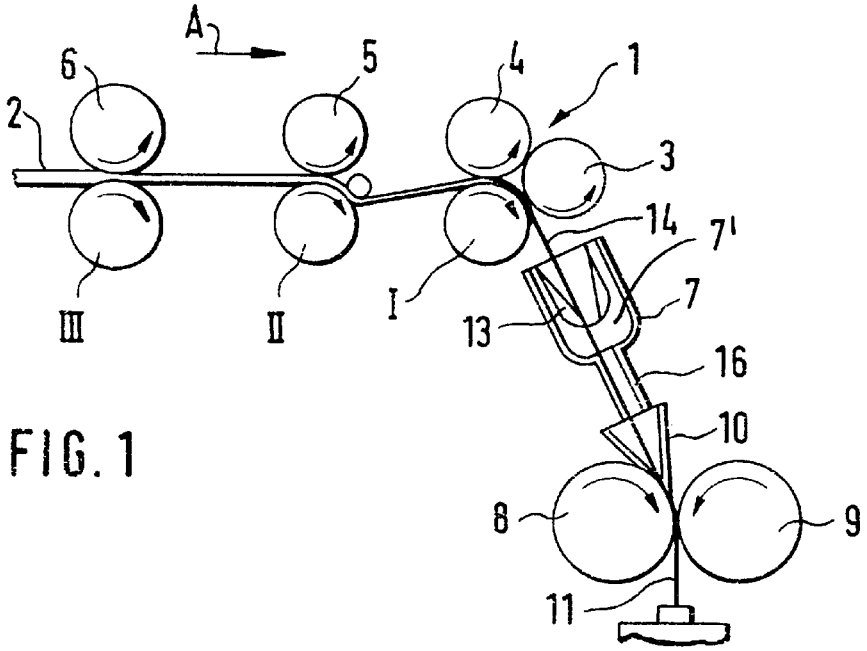
FIG. 1
FIG. 2a
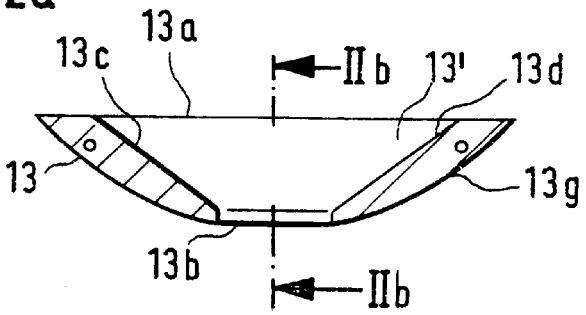
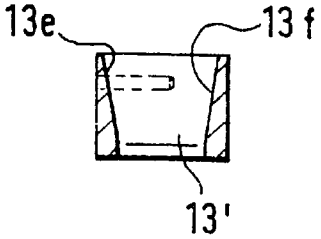
FIG. 2b

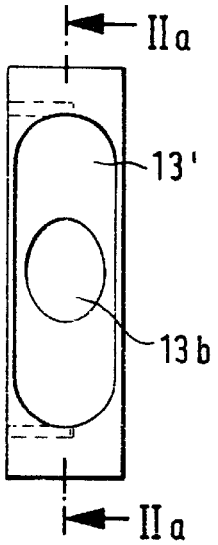
FIG.2c
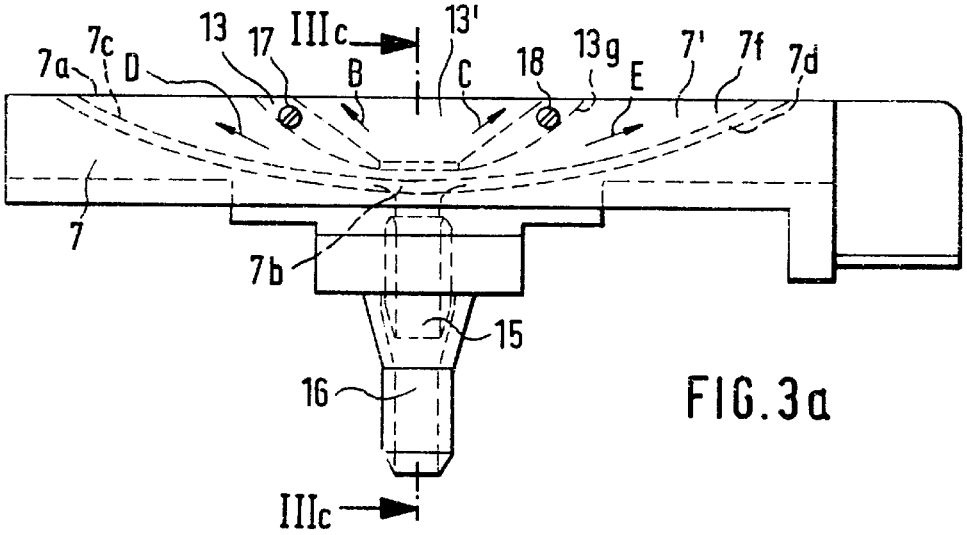
FIG.3a
FIG.3b
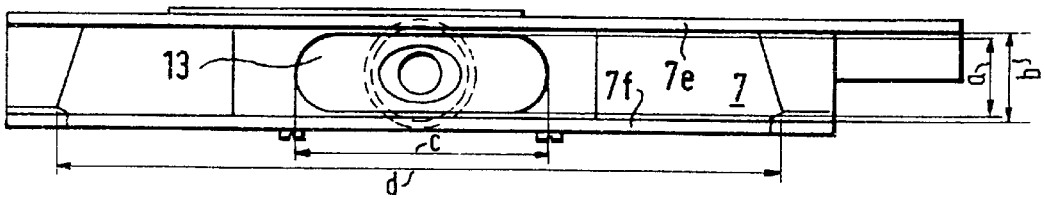

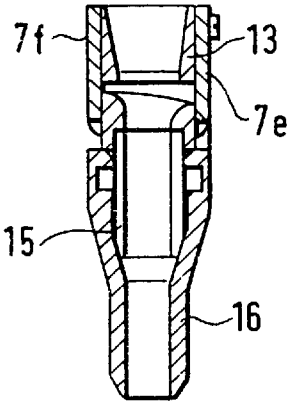
FIG. 3c
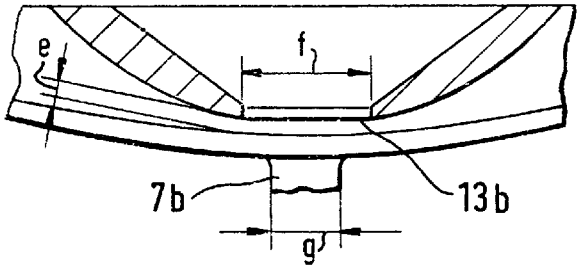
FIG. 3d
FIG. 4a
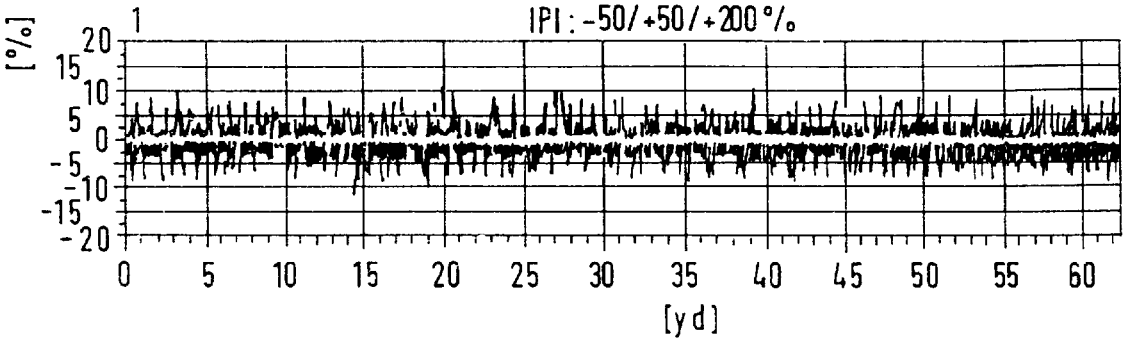

FIG. 4b
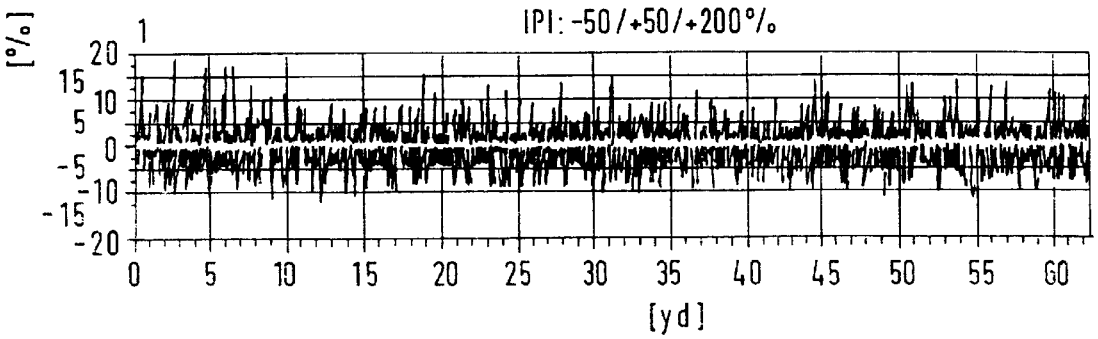
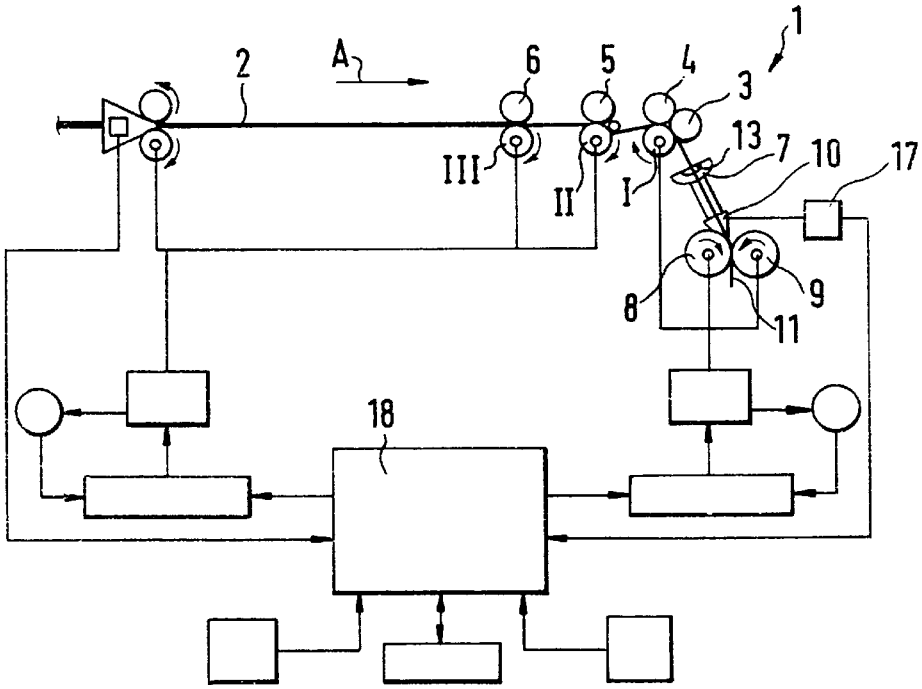
FIG. 5

SLIVER GUIDING ASSEMBLY FOR A DRAW FRAME

CROSS REFERENCE TO RELATED APPLICATION

This application claims the priority of German Application Nos. 198 16 812.8 filed Apr. 16, 1998 and 199 09 040.8 filed Mar. 2, 1999, which are incorporated herein by reference.

BACKGROUND OF THE INVENTION

This invention relates to a device arranged at the outlet of a draw frame. The draw frame has, immediately downstream of the output rolls of the draw unit, a sliver guide for the outputted blended sliver (composed of a plurality of drawn slivers). The sliver guide is arranged upstream of a sliver trumpet which, in turn, is associated with after-connected withdrawing rolls. The sliver guide has a conical or concave surface provided with a passage and is constructed such that air may be removed therefrom during operation.

In a known device, as disclosed in German Offenlegungsschrift (application published without examination) 26 23 400, the sliver guide has a slide surface of concave configuration, and along its upper and lower edges recesses are provided for allowing air to escape. A symmetrically oriented guide channel is provided in the slide surface. The sliver which is discharged by the output rolls of the draw unit and which has a width of, for example, 100 mm, engages directly the slide face and is guided by its concave shape into the inlet opening of the guide channel. When the output speed of the draw frame is increased, for example, to 800 m/min and above (for example, to 1000 m/min), the air which flows back onto the sliver from the narrow passage of the sliver guide constitutes a source of disturbance. The effect of the backflow of air, because of the significant compression of the sliver, increases more than proportionately to the speed increase. The environmental air is entrained by the sliver into the passage at an air flow rate which increases proportionately to the running speed of the sliver. In case the sliver is densified from a large width as it is forced to pass through the passage, then at speeds above 800 m/min the backflow speed of air is excessively high. It is a further disadvantage of known arrangements that the significant compression of the sliver leads to excessive friction between the wall face of the inlet and outlet opening of the sliver guide.

SUMMARY OF THE INVENTION

It is an object of the invention to provide a device of the above-outlined type from which the discussed disadvantages are eliminated to thus make possible a disturbance-free gathering and guiding of the slivers particularly at high output and sliver speeds and to improve the uniformity of the produced sliver blend.

This object and others to become apparent as the specification progresses, are accomplished by the invention, according to which, briefly stated, the device is a sliver guiding assembly disposed at the outlet of the drawing unit of a draw frame; it includes a sliver guide having a wall face converging in a direction of the advancing direction of the sliver and a passage provided in the wall face. The sliver bundle is adapted to travel through the passage in the advancing direction. A sliver leading element is disposed upstream of the passage as viewed in the sliver advancing direction for gathering the sliver bundle and for guiding it toward the passage. Further, an arrangement is provided for maintaining communication between a zone of the sliver guide and enviromental air; the zone is defined between the outlet of the sliver leading element and the inlet of the passage.

By providing a sliver leading element upstream of the sliver guide, the sliver is guided in two ways, that is, it is laterally gathered (pre-formed) and is led towards the sliver guide in the direction of its passage opening. The sliver is gathered by the sliver leading element essentially to such an extent that the adjoining parallel-running slivers arrive into engagement with one another. At the same time, the side walls of the sliver leading element guide the sliver bundle into the sliver guide in such a manner that the friction is reduced between the outermost slivers of the sliver bundle, on the one hand and the inner faces of the side walls of the passage opening, on the other hand. Further, the sliver leading element affects a removal of air from the sliver so that the sliver leading element functions as a pre-densifier. By virtue of the fact that the reduced air flow returning from the passage opening of the sliver guide is guided away from between the sliver leading element and the sliver guide, an air accumulation in front of the sliver guide and, consequently, an interfering turbulent flow that would affect the pre-densified sliver is avoided. It is thus an important advantage of the invention that, by gathering and densifying the sliver in the sliver leading element, the air is removed particularly from the mid region of the sliver guide. In this manner, advantageously a sliver velocity of above 800 m/min may be realized over an extended period without disturbances. Further, slivers in a very fine number range, for example, Nm 0.35 may be processed without difficulties. The invention also provides that the uniformity of the sliver exiting from the sliver trumpet is not interfered with. The device according to the invention may be advantageously used for lower sliver speeds as well (for example, under 800 m/min).

The invention has the following additional advantageous features:

- The sliver runs at high speed, preferably at least at 800 m/min.
- The sliver bundle is composed of lightweight slivers.
- The sliver leading element is replaceable.
- The sliver leading element has at least two converging guide faces as well as a bottom face and a top face and in the top face a throughgoing aperture is provided.
- The inlet cross section of the sliver guiding element has a greater area than the outlet cross section thereof.
- That outer face of the sliver leading element which is oriented towards the sliver guide has a convex configuration.
- The cross-sectional area of the outlet opening of the sliver leading element is greater than the cross-sectional area of the passage of the sliver guide.
- The width of the sliver guide is greater than its height.
- The width of the sliver leading element is greater than its height.
- The sliver leading element is positioned upstream of the passage of the sliver guide as viewed in the direction of sliver advance.
- The sliver leading element is arranged essentially in the inlet chamber of the sliver guide.
- The cross-sectional configuration of the outlet opening of the sliver leading element is oval.
- The cross-sectional configuration of the passage of the sliver guide is circular.

The cross-sectional configuration of the passage of the sliver guide is oval.

BRIEF DESCRIPTION OF THE DRAWINGS

FIG. 1 is a schematic side elevational view of a sliver drawing unit incorporating the invention.

FIG. 2*a* is a sectional top plan view of a sliver leading element according to a preferred embodiment of the invention, taken along line II*a*—II*a* of FIG. 2*c*.

FIG. 2*b* is a sectional side elevational view taken along line II*b*—II*b* of FIG. 2*a*.

FIG. 2*c* is a front elevational view of the construction shown in FIG. 2*a*.

FIG. 3*a* is a top plan view of a sliver leading element according to another preferred embodiment of the invention.

FIG. 3*b* is a front elevational view of the structure shown in FIG. 3*a*.

FIG. 3*c* is a sectional side elevational view, taken along line III*c*—III*c* of FIG. 3*a*.

FIG. 3*d* is a schematic top plan view of a portion of the structure illustrated in FIG. 3*a,* showing dimensional relationships.

FIG. 4*a* is a mass diagram of the sliver uniformity obtained when using the device according to the invention.

FIG. 4*b* is a mass diagram of the sliver uniformity obtained without using the device according to the invention.

FIG. 5 is a schematic side elevational view, with block diagram, of a sliver drawing unit, including an electronic control-and-regulating device with sliver thickness measurement of the drawn sliver.

DESCRIPTION OF THE PREFERRED EMBODIMENTS

FIG. 1 illustrates a drawing unit 1 which is part of a draw frame, such as an HSR model manufactured by Trutzschler GmbH & Co. KG, Monchengladbach, Germany. Also referring to the left-hand end of FIG. 5, the drawing unit 1 has an inlet where a plurality of slivers 2 pulled from coiler cans by a pair of withdrawing rolls, advance in the sliver advancing direction A and enter the drawing unit 1 as they pass through a sliver guide and a measuring member accommodated therein.

The drawing unit 1 is a 4-over-3 construction, that is, it is composed of a lower output roll I, a lower mid roll II and a lower input roll III as well as four upper rolls 3, 4, 5 and 6. The sliver bundle 2, composed of a plurality of slivers, is drafted in the drawing unit 1. The sliver drawing process is composed of a preliminary drawing followed by a principal drawing. The roll pairs composed of rolls 6, III and 5, II form the preliminary drawing field, whereas the roll pair composed of rolls 5, II and the roll assembly composed of rolls 3, 4, I constitute the principal drawing field. The drawn slivers 14 arrive at the outlet of the drawing unit, enter a sliver guide 7 and are, by means of withdrawing rolls 8, 9 pulled through a sliver trumpet 10 in which the slivers are gathered into a blended sliver 11 which is subsequently deposited in coiler cans by a sliver coiler (not shown).

In an inlet chamber 7' of the sliver guide 7 a sliver leading element 13 structured according to the invention is arranged. Thus, the sliver leading element 13 is situated upstream of the sliver-treating part proper of sliver guide 7 and introduces the sliver thereinto.

Turning to FIGS. 2*a,* 2*b* and 2*c,* the sliver leading element 13 has a funnel-shaped configuration and is provided with an inlet opening 13*a* and an outlet opening 13*b*. The inner space 13' of the sliver leading element 13 is formed by two converging conical lateral surfaces 13*c* and 13*d* having a relatively large angle of convergence as well as converging top and bottom surfaces 13*e* and 13*f* whose angle of convergence is relatively small. The inlet opening 13*a* has a greater area than the outlet opening 13*b*. The wall faces 13*c,* 13*d,* 13*e* and 13*f* of the inner space 13' thus form a conical or concave slide face for the sliver 14. The outer face 13*g* of the sliver leading element 13 is of essentially convex configuration.

Turning to FIGS. 3*a* and 3*b,* the funnel-shaped sliver guide 7 has an inlet opening side 7*a* and a passage 7*b*. The inner space 7' of the sliver guide 7 is formed of two concave converging side faces 7*c* and 7*d* which have a relatively large converging angle and a planar top face 7*e* and a planar bottom face 7*f* which converge at a relatively small converging angle. The inlet opening 7*a* has a larger area than the passage 7*b*. The sliver leading element 13 is arranged in the inner space 7' of the sliver guide 7 upstream of the passage 7*b* as viewed in the sliver advancing direction A. As seen in FIG. 3*b,* the width d of the sliver guide 7 is greater than its height b and the width c of the sliver leading element 13 is greater than its height a. These dimensional relationships make it possible to insert the sliver leading element 13 into the inner space 7' of the sliver guide 7. As seen in viewing FIGS. 3*a* and 3*d* together, the convex outer face 13*g* of the sliver leading element 13 is spaced at a distance e from the oppositely located inner side faces 7*c,* 7*d* of the sliver guide 7, whereby the inner space 7' is divided into two interconnected spaces which communicate with the environmental air through the inlet opening 7*a*. As further seen in FIG. 3*d,* the diameter f (or the cross-sectional area) of the outlet opening 13*b* of the sliver leading element 13 is greater than the diameter g (or the cross-sectional area) of the passage 7*b*. With reference to FIGS. 1, 3*a,* 3*c* and 5, the passage 7*b* is adjoined by consecutive transfer tubes 15 and 16 which guide the gathered sliver 14 into the sliver trumpet 10. The sliver leading element 13 is replaceably mounted in the sliver guide 7 by means of screws 17 and 18.

In operation, the sliver bundle 14 discharged by the roll pair composed of rolls 3, I enters the inner chamber 13' through the inlet opening 13*a* and impinges on the inner faces of the sliver leading element 13. The inner faces cause the slivers to converge and to be guided towards the outlet opening 13*b*. During this occurrence, the sliver bundle 14 is condensed and, at the same time, air is pressed out therefrom which escapes in the direction of the arrows B and C (FIG. 3*a*) through the inlet opening 13*a* into the environment against the sliver advancing direction A. The sliver bundle 14 travels through the outlet opening 13*b,* passes through the inner chamber 7' and enters the passage 7*b* of the sliver guide 7. By virtue of the fact that, as shown in FIG. 3*d,* the cross-sectional area of the passage 7*b* is less than that of the outlet opening 13*b* of the sliver leading element 13, further air is pressed out of the sliver bundle 14 which escapes into the atmosphere in the direction of the arrows D, E through the two chambers of the inner chamber 7' and through the opening 7*a*.

FIGS. 4*a* and 4*b* each show a mass diagram of the sliver uniformity. The diagram of FIG. 4*a* shows the sliver 2 drawn in the presence of the sliver leading element according to the invention, whereas the diagram of FIG. 4*b* shows a sliver drawn without such component. The measurements were made on an HSR draw frame, manufactured by Trützschler GmbH & Co. KG, at a draft magnitude of 1.5 and an output speed of 660 yds/min. The same fiber material was processed in both instances. By using the device according to the invention the sliver number fluctuations are appreciably less than those shown in FIG. 4*b*.

Turning to FIG. 5, at the outlet of the drawing unit 1 an outlet measuring member 17, associated with the sliver trumpet 10, measures a sliver magnitude which is proportional to the outrunning sliver mass. Such an arrangement is described, for example, in German Offenlegungsschrift (application published without examination) 195 37 983. The measuring signals (magnitudes) of the measuring member 17 are applied during the drawing process to a central computer unit 18 (control-and-regulating device) and are evaluated. The measuring values of the output measuring member 17 serve for monitoring the outputted sliver 18.

It will be understood that the above description of the present invention is susceptible to various modifications, changes and adaptations, and the same are intended to be comprehended within the meaning and range of equivalents of the appended claims.

What is claimed is:

1. In a draw frame including a drawing unit having an output roll assembly for simultaneously advancing a plurality of slivers in an advancing direction;

a sliver trumpet disposed downstream of said output roll assembly as viewed in said advancing direction; and a sliver guiding assembly disposed between said output roll assembly and said sliver trumpet for guiding the slivers, drawn in said drawing unit, directly to said sliver trumpet;

the improvement wherein said sliver guiding assembly comprises (a) a sliver guide having (1) a wall face converging in said advancing direction and defining a funnel-shaped space having an elongated cross-sectional outline as viewed in a plane perpendicular to said advancing direction;

(2) a passage provided in said wall face; said passage having an inlet; said slivers being adapted to travel through said passage in said advancing direction;

(b) a sliver leading element disposed upstream of said passage as viewed in said advancing direction for gathering the slivers and for guiding said slivers toward said passage; said sliver leading element having an inlet, an outlet and an elongated cross-sectional outline as viewed in a plane perpendicular to said advancing direction; and (c) means for providing communication between a zone of said sliver guide and enviromental air; said zone being defined between said outlet of said sliver leading element and said inlet of said passage.

2. The sliver guiding assembly as defined in claim 1, further comprising means for removably securing said sliver leading element to said sliver guide.

3. The sliver guiding assembly as defined in claim 1, wherein said sliver leading element has at least two conical inner slide faces converging in said sliver advancing direction.

4. The sliver guiding assembly as defined in claim 1, wherein said sliver leading element has at least two concave inner slide faces converging in said sliver advancing direction.

5. The sliver guiding assembly as defined in claim 1, wherein said sliver leading element has two conical inner lateral slide faces converging in said sliver advancing direction and a bottom face.

6. The sliver guiding assembly as defined in claim 5, wherein said sliver leading element further has a top inner face.

7. The sliver guiding assembly as defined in claim 6, further comprising a throughgoing opening provided in said top inner face.

8. The sliver guiding assembly as defined in claim 1, wherein a cross-sectional area of said inlet of said sliver leading element is larger than a cross-sectional area of said outlet of said sliver leading element.

9. The sliver guiding assembly as defined in claim 1, wherein said sliver leading element has a convex outer face oriented toward said sliver guide.

10. The sliver guiding assembly as defined in claim 1, wherein a diameter of said outlet of said sliver leading element is larger than a diameter of said passage of said sliver guide.

11. The sliver guiding assembly as defined in claim 1, wherein a cross-sectional area of said outlet of said sliver leading element is larger than a cross-sectional area of said passage of said sliver guide.

12. The sliver guiding assembly as defined in claim 1, said sliver leading element being accommodated in said funnel-shaped space.

13. The sliver guiding assembly as defined in claim 1, wherein said outlet of said sliver leading element is circular.

14. The sliver guiding assembly as defined in claim 1, wherein said outlet of said sliver leading element is oval.

15. The sliver guiding assembly as defined in claim 1, wherein said passage has a circular cross section.

16. The sliver guiding assembly as defined in claim 1, wherein said passage has an oval cross section.

17. A sliver guiding assembly for the passage of a sliver bundle discharged in a sliver advancing direction by output rolls of a drawing unit forming part of a draw frame; the assembly comprising (a) a sliver guide having (1) a wall face converging in a direction of said advancing direction; and (2) a passage provided in said wall face and having an inlet; said sliver bundle being adapted to travel through said passage in said advancing direction;

(b) a sliver leading element disposed upstream of said passage as viewed in said advancing direction for gathering the sliver bundle and for guiding said sliver bundle toward said passage; said sliver leading element having an inlet and an outlet;

(c) means for providing communication between a zone of said sliver guide and enviromental air; said zone being defined between said outlet of said sliver leading element and said inlet of said passage; and (d) means for removably securing said sliver leading element to said sliver guide.

* * * * *